US005871104A

United States Patent [19]

Martinez et al.

[11] Patent Number: 5,871,104

[45] Date of Patent: Feb. 16, 1999

[54] ADJUSTABLE SUPPORT APPARATUS SUCH AS ADJUSTABLE BOOKENDS

[76] Inventors: Beatrice E. Martinez, 1401 Middlebury Dr.; Louis S. Polster, 2205 Marthas Rd., both of Alexandria, Va. 22307

[21] Appl. No.: 747,391

[22] Filed: Nov. 12, 1996

[51] Int. Cl.[6] ..... A47F 7/00

[52] U.S. Cl. ..... 211/43

[58] Field of Search ..... 211/43, 51, 59.3, 211/184; 108/61

[56] References Cited

U.S. PATENT DOCUMENTS

| | | | |
|---|---|---|---|
| 1,674,582 | 6/1928 | Wheeler . | |
| 2,545,844 | 3/1951 | Cougias . | |
| 2,911,103 | 11/1959 | Kunkler . | |
| 3,389,805 | 6/1968 | Yoemans . | |
| 4,128,120 | 12/1978 | Frey . | |
| 4,135,626 | 1/1979 | Cawood | 211/43 |
| 4,606,465 | 8/1986 | Moustakas | 211/43 |
| 4,742,936 | 5/1988 | Rein . | |
| 5,217,122 | 6/1993 | Martinez . | |

FOREIGN PATENT DOCUMENTS

| | | |
|---|---|---|
| 359275 | 3/1906 | France . |

OTHER PUBLICATIONS

The Bookworm, Helix Ltd., date unknown.

*Primary Examiner*—Alvin Chin-Shue
*Assistant Examiner*—Sarah Purol
*Attorney, Agent, or Firm*—Oliff & Berridge, PLC

[57] ABSTRACT

An apparatus for supporting a variable number of objects, such as books or CDs, on a shelf unit includes two or more relatively movable support members having surfaces defining substantially opposed planes of support for supporting the objects, and a constant force spring operably connecting the two support members to support the variable number of objects therebetween. The apparatus can include: a track section affixable parallel to a shelf unit; at least one constant force spring; at least one slidable track element constrained for longitudinal movement along the track section, the slidable track element being operably connected to the constant force spring; and/or at least one support member defining a plane of support for the objects connected to the slidable track element. The support member, which is movable due to its connection to the slidable track element, is capable of retaining at least one book or other object between the support member and a second support member, which can be part of the existing shelf unit or a fixed or movable support member having a surface defining an opposed plane of support for an opposite end of the objects downwardly suspended from the track section. To aid in operability, a rate of travel governor, lock member and handle can be provided.

31 Claims, 10 Drawing Sheets

ADJUSTABLE SUPPORT APPARATUS SUCH AS ADJUSTABLE BOOKENDS

BACKGROUND OF THE INVENTION

The present invention relates to an apparatus for supporting a variable number of objects, such as books, CDs or the like, on a shelf unit. In particular, the apparatus includes two or more relatively movable members comprising opposed surface defining planes of support biased toward one another to support the variable number of objects therebetween.

Although numerous relatively movable biased bookends are known in the art, there are problems with existing structures. Shelving comes in several lengths, varying from a foot in length to ten or more feet. Known spring-loaded bookends have a fairly limited travel distance and are not capable of the degree of travel flexibility necessary to accommodate use with large shelves. In any shelf, two extreme conditions could occur: the shelf could be nearly full of books or it could be nearly empty. As the length of the shelf increases, so must the travel of the bookend if these extreme conditions are to be met. Known spring-loaded bookends are not capable of meeting these conditions for long book shelves and oftentimes not even for short shelves. A reason for this is in the spring element used. Tension/compression springs have a large dead space in order to provide a low change in force constant. That is, they must have a large number of coils, which occupy a large area of space when contracted. Thus, with such a construction, it is difficult to accommodate a very small number of books due to the dead space and difficult to accommodate a large number of books with the spring fully extended because maintaining the spring extended for long periods of time can result in spring fatigue and failure.

Another problem with spring-loaded bookends is a clearance problem associated with some shelving. Often shelving is sized to accommodate a certain size of book. Although some shelving may allow greater tolerances, other shelving has small tolerances in dimensions such as overall height between shelves, or in shelf depth relative to the size of books being shelved. As such, an add-on bookend needs to have small dimensions to allow use of the largest possible height and number of books or other objects being supported. However, some bookends fail to accomplish this.

Additionally, known spring-loaded bookends have no structure provided that can control, stop or govern the amount of force applied. Tension/compression springs have varying force based on the amount of extension due to the non-linear nature inherent in such springs. Moreover, known bookends have no mechanisms provided to govern or control the rate/time of return travel. As such, known adjustable, spring-loaded bookends can be awkward or even unsafe to operate due to rapid retraction. Additionally, some bookends have inconsistent retraction due to varying application force caused by use of a non-linear spring force that applies more force at some positions of extension/retraction than other positions (i.e., more or less force is applied at extreme end positions than intermediate positions).

Moreover, while some bookends have end stops that define the ends of travel, known spring-loaded bookends are not capable of adjustably locking the bookend at intermediate positions, such as to facilitate easy book removal or addition.

A particular known bookend is the Bookworm™ made by Helix, Ltd. of England. This bookend consists of one L-shaped member riveted to a constant force spring with a large diameter. The bookend is placed on a horizontal surface and contains one or a few books or other objects between the L-shaped member and the large diameter coil. However, several problems still exist with such a device. First, the device cannot accommodate a large number of books as an unfixed structure like this is increasingly unstable the larger the extension. Second, the large diameter coil takes up a substantial amount of space, thus reducing the capacity of the shelf unit. Third, as the spring itself serves as a support surface, the Bookworm™ is limited to use with objects having a limited range of heights, as taller or shorter ones may not be adequately supported by the coil of the spring. Moreover, as the constant force spring is unwound, the effective height of the end support is reduced. Fourth, the bookworm is difficult to operate as both hands are necessary to extend the structure to add additional objects. Fifth, the Bookworm is provided as a support structure with wide dimensions to contain books, etc. within its own structure by closing gaps on itself and is not concerned with use in conjunction with an existing bookshelf.

There is a need for an adjustable apparatus that can support a variable number of objects, such as books, and overcome the deficiencies of the prior art.

SUMMARY OF THE INVENTION

The present invention overcomes the above problems and provides an apparatus for supporting a variable number of objects, such as books, on a shelf unit. The apparatus may include two or more relatively movable members comprising substantially opposed surfaces. In embodiments, a tension spring such as a constant force spring operably connects the two members to support the variable number of objects therebetween.

In one embodiment of the invention, the apparatus can comprise: a stationary base track section positionable longitudinally adjacent a horizontal shelf; at least one slidable track element constrained for longitudinal movement along the track section; at least one support member comprising a surface defining a plane of support, operably connected to the at least one track element for movement therewith; and at least one constant force spring operably connected to the at least one track element to apply a predetermined biasing force along the track section to the at least one track element. The support member containing the surface defining a plane of support can be any of various forms—e.g., a single planar surface or a number of surfaces defining a plane of support, such as a curved wire design that defines such a support plane. The support surface is movable due to its connection to the slidable track element, and is capable of retaining at least one book or other object between the member and a second support member, which can be part of the existing shelf unit or a fixed or movable member defining an opposing plane of support and extending from a base portion or another track element.

To govern and control movement of the two support members relative to one another, a one-way or two-way governor is preferably operably connected to the at least one constant force spring to control/govern the movement thereof.

Additionally, to aid in use by an operator such as a librarian, a handle may be provided. The handle allows for easy manual movement of one support member relative to the other.

Further, a lock may be provided. The lock allows a user to selectably lock the apparatus in one or more (or even infinite) positions intermediate ends of travel of the apparatus. Such a feature frees the hands of the operator, allowing both hands to remove or add books or other objects between the opposed support members without having the spring retract.

Additionally, to provide increased safety, the constant force spring may be located within, behind or in front of the at least one track section so as to be unexposed during normal use. In such a case, an opening on the track section may be made narrow to prevent hands or fingers from entry into the track element. Alternatively, the opening can be provided on an unexposed side of the apparatus (e.g., if the apparatus is provided above or behind a shelf, the opening could be provided between the apparatus and a shelf to prevent ready access to the opening and moving parts). Moreover, the structure could be designed such that existing books on the shelf cover or inhibit access or exposure to moving parts.

According to another embodiment useful for long shelves, three or more vertical relatively movable support members can be provided. These can be independently movable by separate constant force springs.

In any of these embodiments, the at least one constant force spring can have different, changeable spring force by substitution of higher/lower spring force springs or addition of multiple springs (in parallel) with a combined spring force of a predetermined value. Additionally, in any of these embodiments, the selected spring force can be adapted to achieve different conditions, such as: 1) a spring force sufficient to support the objects between the vertical supports without laterally moving the objects; or 2) a spring force sufficient to support and laterally move the objects, closing gaps between adjacent objects.

BRIEF DESCRIPTION OF THE DRAWINGS

Embodiments of the invention will be described in detail with reference to the following drawings, wherein.

DETAILED DESCRIPTION OF EMBODIMENTS

For convenience, reference to the books or other objects herein will often be expressed in terms of books.

Figure 1:
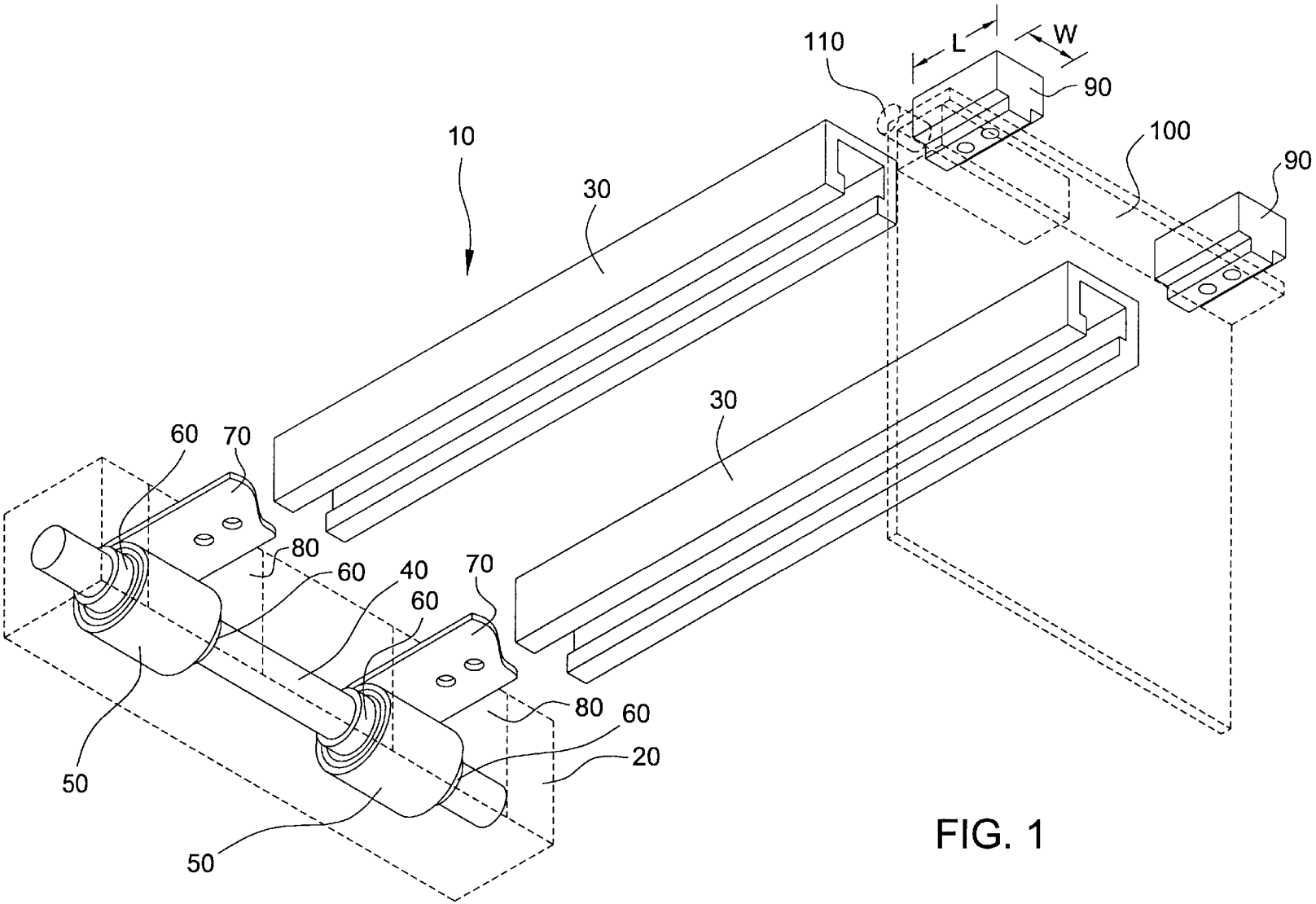
FIG. 1 illustrates an exploded perspective view of an apparatus according to a first embodiment of the invention.

FIG. 1 (in exploded form) is directed to an apparatus 10 that includes a stationary base portion 20 (shown in outline form so that internal structure can be better illustrated) on which two longitudinal track sections 30 are fixedly attached. These sections can be integral with base portion 20, screwed on, adhesively bonded, welded or otherwise positioned adjacent portion 20. Base portion 20 and track sections 30 can be, for example, injection molded, extruded or machined from plastic such as Delrin, machined or extruded from a lightweight metal such as aluminum or fabricated from wood. Base portion 20 can be cut or formed to any desired suitable size up to the depth of the particular shelf in which the retaining apparatus will be affixed. Track sections 30 can be cut to a suitable length determined by the size of shelf for which the retaining apparatus is to be used. Alternatively, to achieve variable retaining apparatus lengths that can accommodate several shelf lengths, the track sections 30 can be telescoping or fit end to end.

Affixed within and axially aligned with transverse base portion 20 is a transverse shaft 40. Preferably, two constant force springs 50 are rotatably supported on shaft 40. Retainer means 60, such as bushings, may be provided to restrict axial movement of the constant force springs 50 along shaft 40.

Ends 70 of constant force springs 50 extend out of apertures 80 of portion 20. Each end 70 is operably connected to a slidable track element 90, such as by screws, rivets, pins or other suitable connection means. Slidable track elements 90 freely slide within track sections 30 by having a length L at least twice as long as width W. This can further be accomplished by use of a close fit and a low coefficient of friction material, such as numerous commercially available plastics such as Delrin or graphite-impregnated plastics, and aluminum. Alternatively, or in addition, grease can be applied to the track section. Even better performance can be obtained if the track element 90 includes ball or roller bearings.

Figure 4:
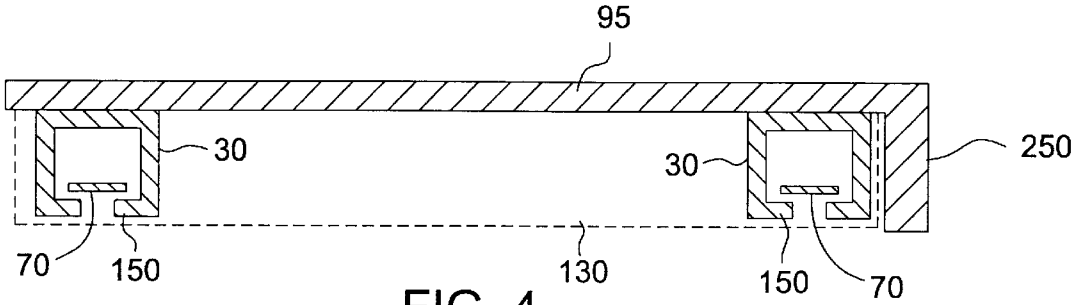
FIG. 4 illustrates a cross-sectional view of the shelf of FIG. 3 taken along line 4—4.

As best shown in FIG. 4, ends 70 of springs 50 can travel within track elements 30. This provides a more aesthetic appearance as well as providing additional safety as moving parts, such as the constant force spring 50, are located within the track 30 or base portion 20. Also, the apparatus can be easily located within a recessed space provided by conventional shelving having a horizontal shelf 95 and a downwardly extending front face 250. When used with such shelving, the apparatus utilizes an existing space that is not used by the books. Thus, book clearance is not reduced or at least the reduction is minimized. Additionally, such an apparatus mounting location, which is above and parallel a shelf having books retained thereon, does not require the weight of the books to rest on the apparatus, allowing lighter materials to be used. Further, in such a mounting configuration, the apparatus can be partially or completely hidden from view such that the book shelf can retain its original appearance. This apparatus can be mounted to the bottom side of an upper shelf, attached to a back vertical member of the shelf unit, or attached to side members of a typical library shelf assembly. Alternatively, the apparatus can be mounted on top of a shelf, underneath books or objects.

As shown in FIG. 1, a downwardly extending bookend 100 (shown in outline form to better illustrate underlying structure) is attached to slidable track elements 90. This provides a support member having a surface defining a plane of support for the objects. A handle 110 may be provided to aid in bookend operation. As better shown in FIG. 3, the retaining apparatus may be mounted on an underside of an upper shelf 95 of a shelf unit while books are rested on a lower shelf 105 of the shelf unit. Bookend 100 is biased toward base portion 20 by the constant force springs 50 with a force F. This retains the books between bookend 100 and a vertical support 120. Additionally, an opposing base portion 130 can be provided opposite base portion 20.

If a book is removed, the apparatus prevents the remaining books from tipping over. If sufficient spring force is provided, the apparatus can also force the set of books to move over sufficiently to close the space left by one or more removed books. Further, if additional books are to be added to the book set, a user can press handle 110 in a direction to the right with sufficient force to overcome the spring force, allowing movement of the bookend relative to the set of books and insertion of additional books. When the additional books have been added, the handle can be released and the adjustable retaining apparatus will automatically bias the bookend 100 against the right hand end of the book set.

Track sections 30 preferably include an inwardly extending lip surface 150 (FIGS. 1 and 4) to: restrict the longitudinal opening of the track section; prevent removal of slidable track elements 90; and minimize the opening for safety reasons so that fingers are less likely to come in contact with moving parts, such as constant force spring 50 and track elements 90, within track sections 30.

In an alternative embodiment, the constant force spring on shaft 40 can be mounted to the slidable track element 90 and the other end of the spring operably connected to the base portion or another vertical support. The effect is the same, biasing of the vertical bookend toward the second vertical support.

Figure 2:
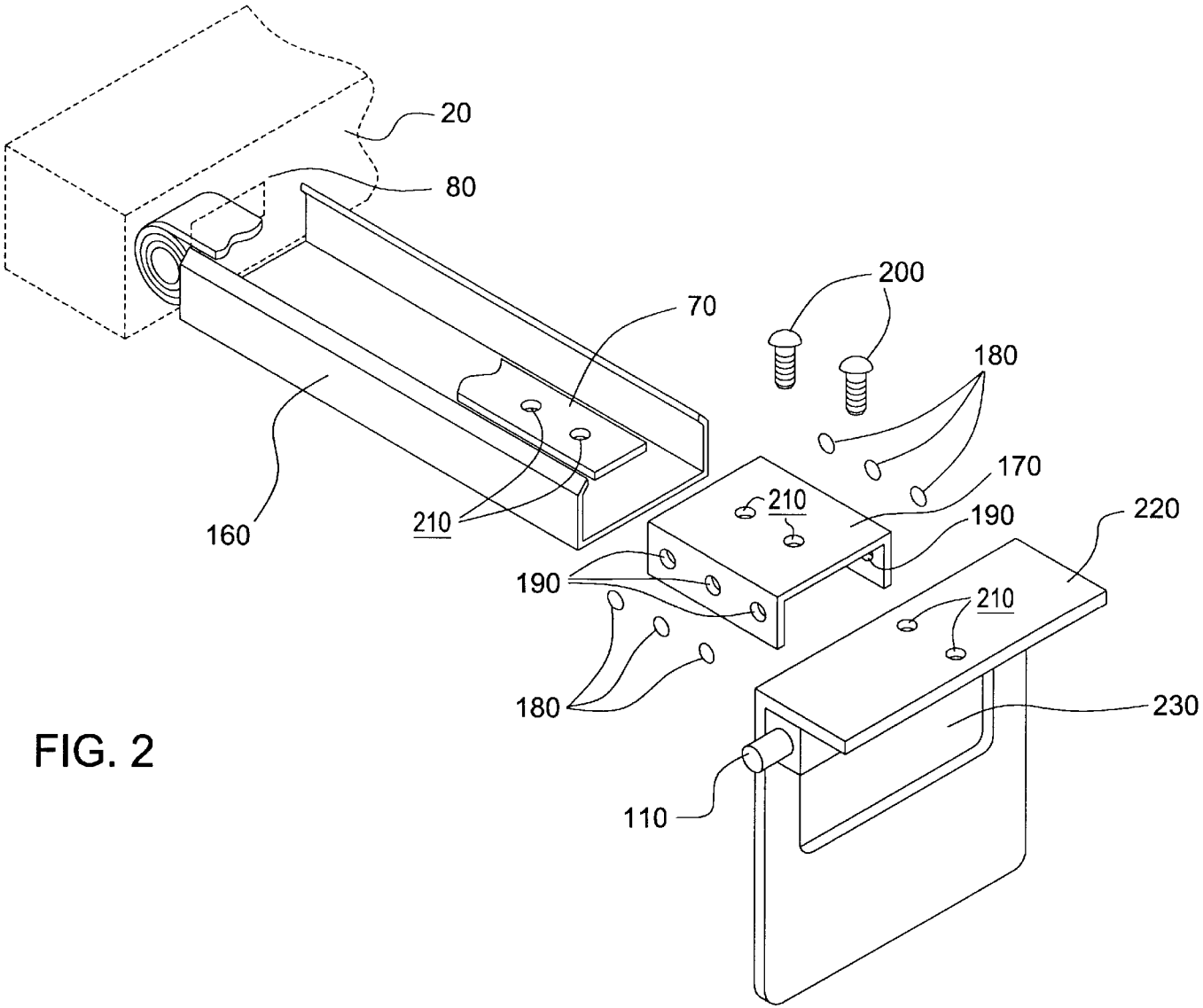
FIG. 2 illustrates an exploded perspective view of an apparatus according to a second embodiment of the invention.

In a second embodiment, as best shown in FIG. 2, a single, wider track section 160 is provided between base portion 20 and an unshown opposite base portion. Again, the constant force spring 50 can be located within base 20 and extendable within track section 160 for safety reasons. However, it is not necessary that spring 50 and end 70 be within track section 160 as track section 160 does not serve a guide purpose for the spring, but mainly encloses the spring 50 and end 70 for safety and aesthetic purposes and guides the track element 170. As such, springs 50 could be externally located from track section 160.

A suitable wide track can be found in conventional drawer slides. Such a slide can be fabricated from a lightweight metal, such as extruded aluminum, or can be molded or machined from a lightweight, high strength plastic. These can be formed or cut to any desired size depending on the particular application. Also, as with the first embodiment, the track section can be telescoping.

Also, as in the first embodiment, a slidable track element 170 can be closely fit within track section 160 and made of a low coefficient of friction material, provided with grease or other lubricant, or provided with ball bearings 180 that are freely received within apertures 190 in track element 170. Note, however, that while track element 170 is shown within track section 160, it could also be located around the track section and achieve similar function and operation.

Figure 7:
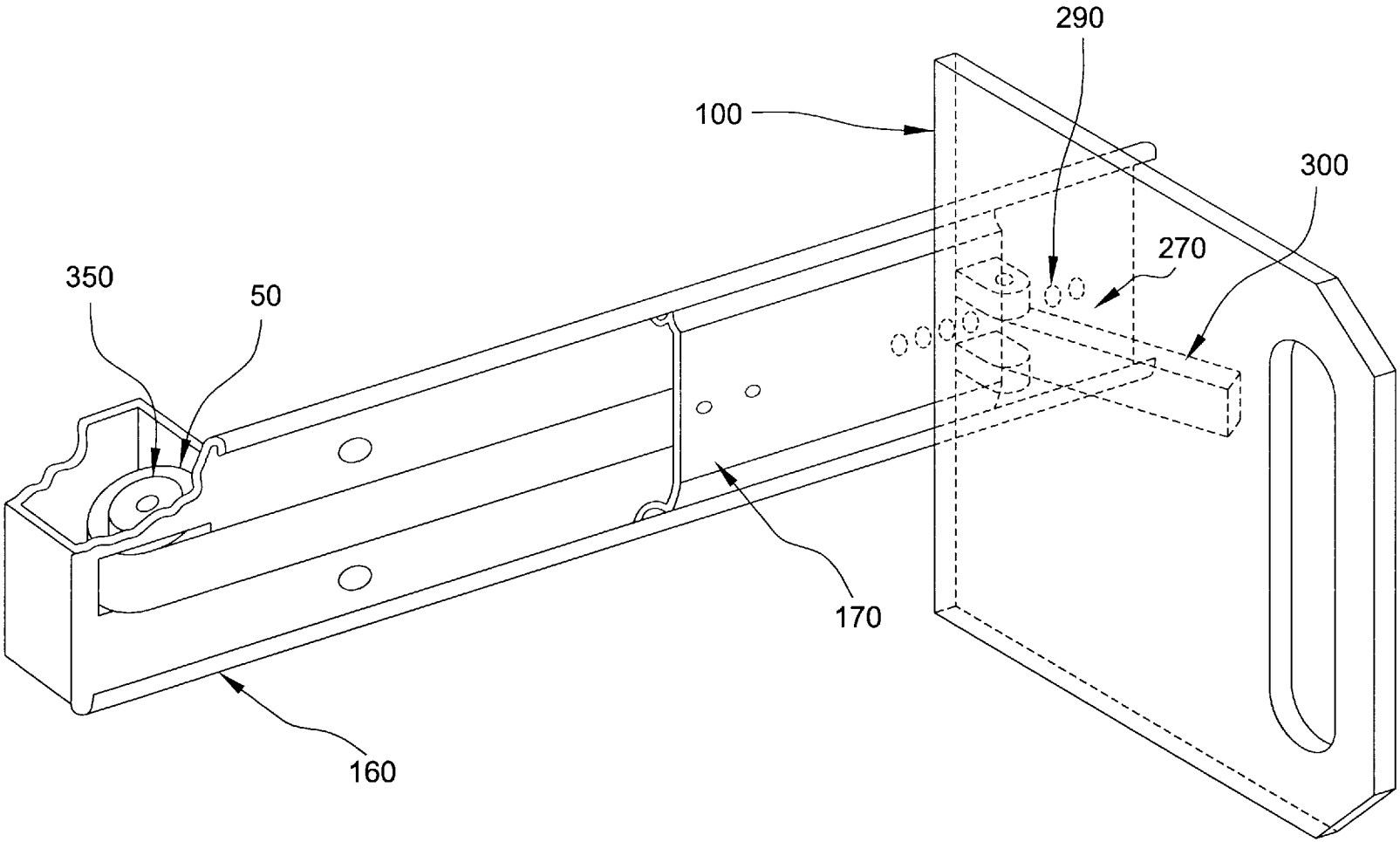
FIG. 7 illustrates a perspective view of an alternative structure for the invention with a lock mechanism.

In this embodiment, the longitudinal opening in the track can be facing up rather than down as in the first embodiment or can face out if mounted behind books (See FIG. 7). As such, when the spring 50 is provided within the track 160, it is covered from view and shielded from a user. Such a construction provides enhanced safety advantages.

Spring end 70 can be operably connected to slidable track element 170 by screws 200, rivets or other suitable fastening means, for example, by providing the fastening means through holes 210 formed in end 70, element 170 and bookend 220. Bookend 220 is similar to bookend 100 except that it includes an aperture 230. Aperture 230 is provided because of the top mounting of the slidable track element 170 and the necessity to provide a downwardly extending bookend. The aperture 230 allows the bookend 220 to travel along track element 160 without interference. As in the first embodiment, a handle 110 is preferable for manual movement of the bookend. If the bookend 220 extends in the opposite direction (180° rotated), the aperture 230 could be eliminated.

Any of the embodiments of the invention can further be provided with a lock mechanism 270, as best illustrated by FIGS. 7–10, to lock the track element 170 and associated bookend 100 in a predetermined position along the track section 160. This will allow the user to add books or remove books with both hands free. Then, when desired, the lock mechanism 270 can be deactivated and the bookend will again be biased against the book set.

FIG. 7 shows a variation of the apparatus of FIG. 2, which is preferably arranged to have the track section 160 tilted 90° relative to the FIG. 2 embodiment. This has an advantage of placing the constant force spring 50 and associated enclosure out of the path of bookend 100. Thus, only the length of track element 170 affects the limiting of travel extent. Like the other embodiments, the bookend 100 is attached to the track to provide a support member having a surface defining a plane of support for the objects to be supported. This embodiment utilizes a vertical cutout as a handle mechanism. This embodiment also utilizes a one-way or two-way governor 350 to control movement of the bookend.

As shown, several apertures 290 are provided along the length of track section 160. Lock mechanism 270 includes a pivotal locking arm 300 pivotally attached to track section 170 and having an engaging member (unshown) at an inner end of the arm 300 that mates with one of the apertures 290 upon pivoting of arm 300. While these holes are shown along only a right hand portion of the track section, they could be provided either: 1) along the entire extent of the track section to provide numerous lock positions; or 2) at only one far right location to provide a single fully extended lock position. The latter is simple and will accommodate many shelf filing needs, by retaining the bookend at the far end of the shelf, allowing the operator to have both hands free to fill, replace or remove books or other objects from the shelf.

Numerous other lock mechanisms are contemplated that can automatically or manually engage to restrain the bookend from movement. Another example is illustrated in FIGS. 8–10.

Figure 8:
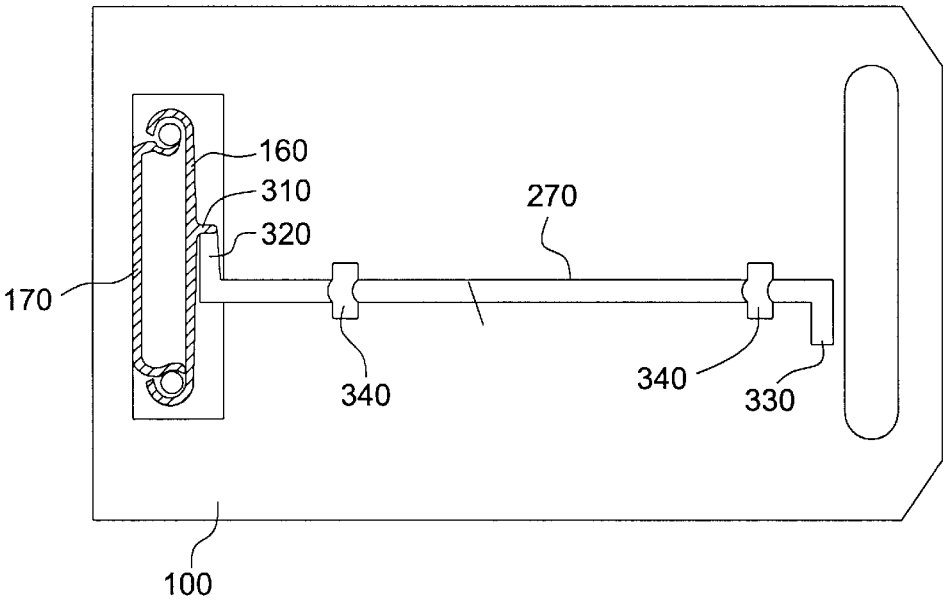
FIG. 8 illustrates a side view of a bookend with an alternative lock mechanism.
Figure 9:
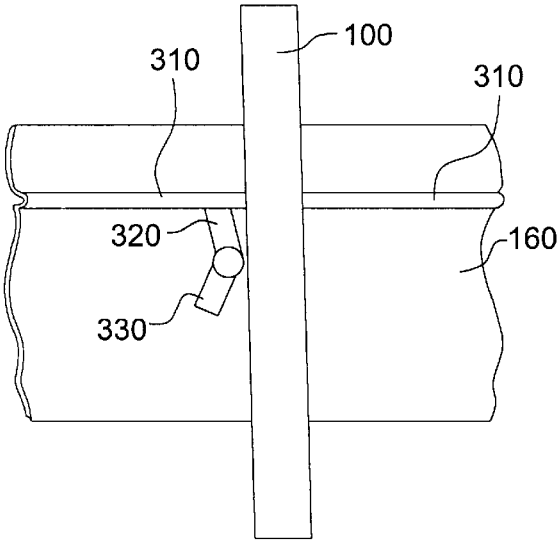
FIG. 9 illustrates an end view of the bookend of FIG. 8 showing the lock mechanism in a locked position.
Figure 10:
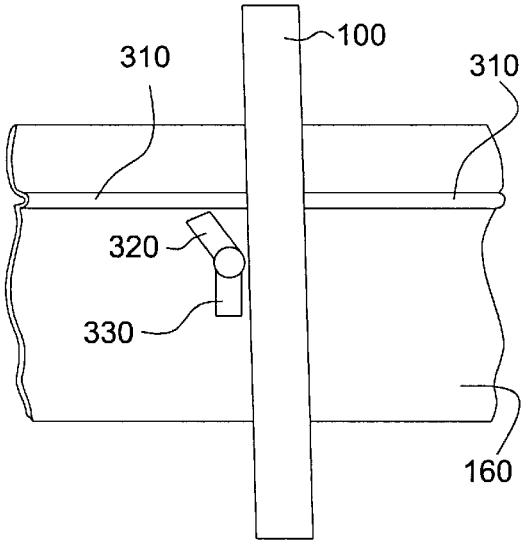
FIG. 10 illustrates an end view of the bookend of FIG. 8 showing the lock mechanism in an unlocked position.

As shown in FIGS. 8–10, bookend 100 is attached to slidable track element 170. Track section 160 is provided with an extended edge 310. Lock mechanism 270 on bookend 100 includes a central rotatable shaft rotatably retained by retaining members 340, an engagement portion 320 that can mate with edge 310, and a handle portion 330. FIG. 9 shows the lock mechanism in a locked position in which the engagement portion 320 is frictionally engaged against an underside of edge 310. Sufficient force is maintained to prevent movement of the bookend. Release of the lock can be achieved by rotation of handle portion 310 as shown in FIG. 10.

This construction can allow free movement of the bookend in one direction (to the right as shown), but prevents movement in an opposite direction (to the left). This is because movement to the right acts on the lock mechanism to disengage contact between the engagement portion 320 and edge 310. However, movement to the left acts on the lock mechanism to increase engagement. Thus, this embodiment can automatically lock the bookend at any position along the track section 160. Release is achieved by grasping the bookend at the vertical slot (handle) and rotating the handle portion 330 of the lock to that shown in FIG. 10. Engagement can be further enhanced by biasing the lock mechanism with a spring (not shown) and/or providing an engaging surface of engagement portion 320 with a high coefficient of friction material, such as rubber.

The retaining apparatus of any of the preceding embodiments can further be enhanced by use of a governor, which can be one-way or two-way to slow down the travel rate of the retaining apparatus. Exemplary configurations for such governors are best illustrated in FIGS. 11–16.

Figure 11:
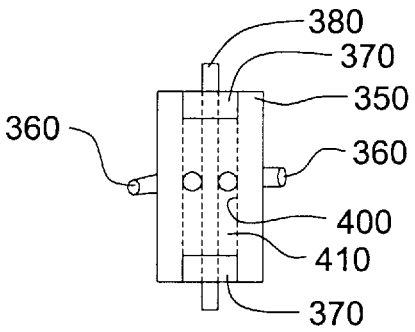
FIG. 11 illustrates a side view of a two-way governor according to the invention.
Figure 12:
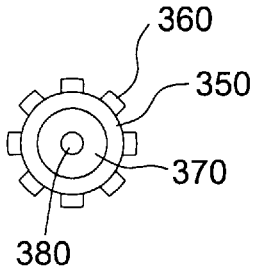
FIG. 12 illustrates a top view of the two-way governor shown in FIG. 11.
Figure 13:
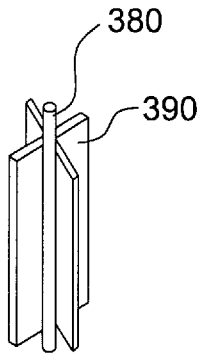
FIG. 13 illustrates a perspective view of a finned shaft used in the governor of FIGS. 11–12.
Figure 14:
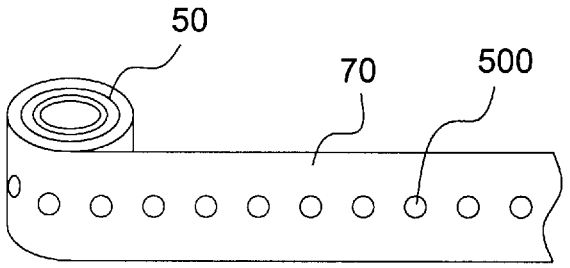
FIG. 14 illustrates a constant force spring used with the governors of FIGS. 11–13.
Figure 15:
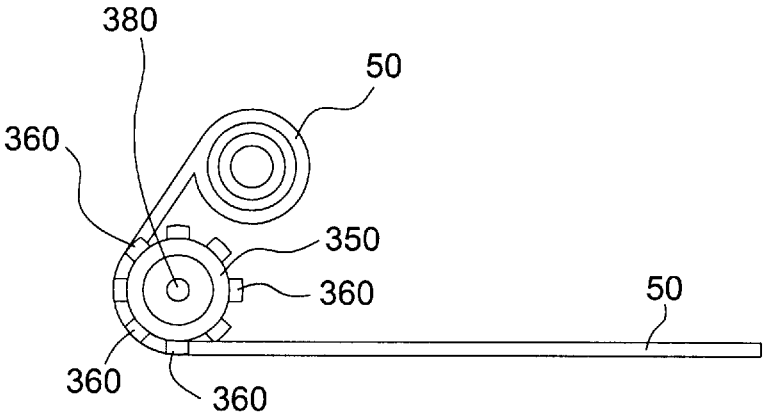
FIG. 15 illustrates a preferred configuration for the governor and constant force spring shown in FIGS. 11–14.

FIGS. 11–13 show a two-way governor 350 for use with a constant force spring 50 having a free end 70 with apertures 500 shown in FIG. 14. Governor 350 includes an outer shell with protuberances 360 around the periphery thereof that mate with corresponding apertures 500 of the constant force spring 50. A central shaft 380 includes fins 390 that rotate within a fluid filled cavity 410 defined within shell wall 400. The shaft is supported by bearings 370. The amount of braking effected by the governor can be adjusted by controlling the viscosity of the fluid and/or the size or configuration of the fins 390. Preferably, the governor provides sufficient speed/rate of return control to prevent rapid snapping back of the bookend 100 due to the force exerted by spring 50. The governor 350 can be mounted within the coiled constant force spring as illustrated in FIG. 2 or, more preferably, as illustrated in FIG. 15, the governor 350 may be located externally.

Figure 16:
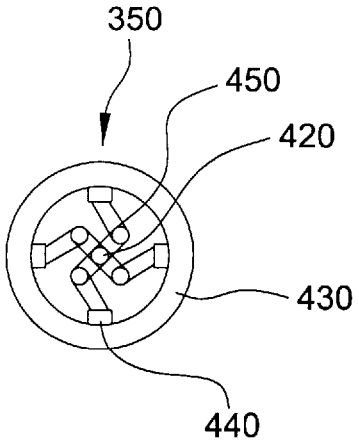
FIG. 16 illustrates an alternative governor structure according to the invention.

Alternatively, as illustrated in exemplary FIG. 16, a friction one-way governor 350, such as that provided on rotary phone dials, could be substituted. In operation, spring 50 would be coiled around rotatable governor housing 430 for frictional engagement therewith. Within governor 350 are friction pads 440, similar to a drum brake, that can frictionally engage an inner surface of housing 430. Pads 440 are connected to a fixed shaft by linkages 450. As evidenced from the drawing, rotation of housing 430 in one direction causes linkages 450 to increase frictional force of pads 440 against housing 430. In the opposite direction, linkages 450 lessen frictional force applied by pads 440. Thus, one-way governing can be simply achieved. Of course, the governor 350 should be positioned such that extension of the bookend 100 has the least resistance to allow easy opening and retraction of the bookend 100 has the most resistance given by governor 350 so that the retraction rate can be controlled. This increases safety of the retaining apparatus as some springs 50, without governing, may generate relatively rapid retraction and possible injury.

Figure 5:
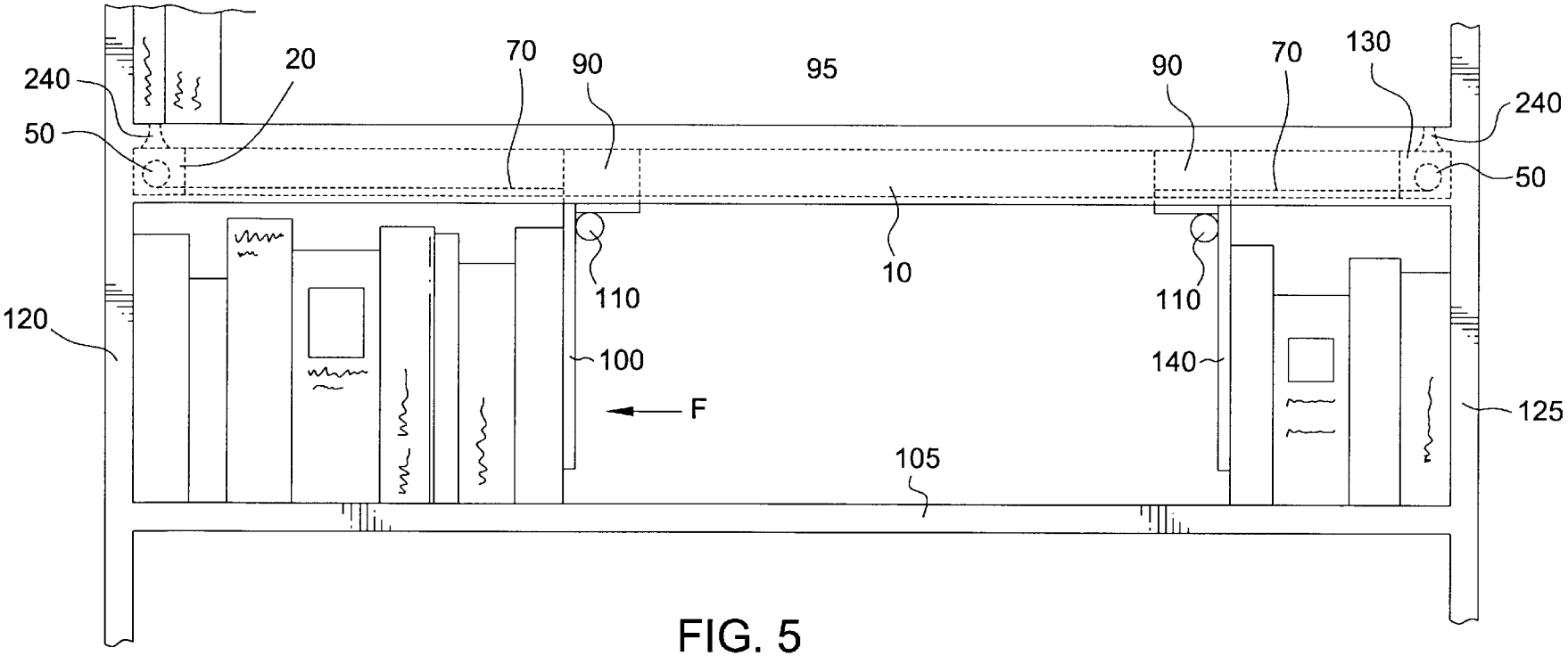
FIG. 5 illustrates a side view of a bookshelf incorporating an apparatus according to a third embodiment of the invention.

In a third embodiment, which may be used when an extremely long shelf is utilized and/or when multiple variable bookends are desired, one bookend can be separately attached to each slidable track element 90. In this case, as shown in FIG. 5, a second shaft having a second constant force spring 50 can be provided in opposing base portion 130 with the second constant force spring 50 aligned with one of the two track sections while the axial shaft in base portion 20 has first constant force spring 50 aligned with the other track section. A second track element 90 having a second bookend 140 attached thereto is provided and operably connected to the second spring 50. In this alternative embodiment, books could be biased against the left vertical support 120 and a right vertical support 125.

In an alternative embodiment, multiple track elements and associated attached bookends can be provided on each track. Constant force springs can be chained together in series between these so that each bookend operates independently and multiple adjustable bookends are provided on a single shelf. This can be achieved by mounting a first spring on a shaft on the base portion as in the first embodiment. An end of the spring is operably connected to a first track element also as in the first embodiment. Then, a second shaft and constant force spring can be mounted on the first track element with an end operably connected to a second track element. This can be repeated for however many track elements and bookends are desired. Of course, the ends of the springs can be reversed as desired.

Figure 3:
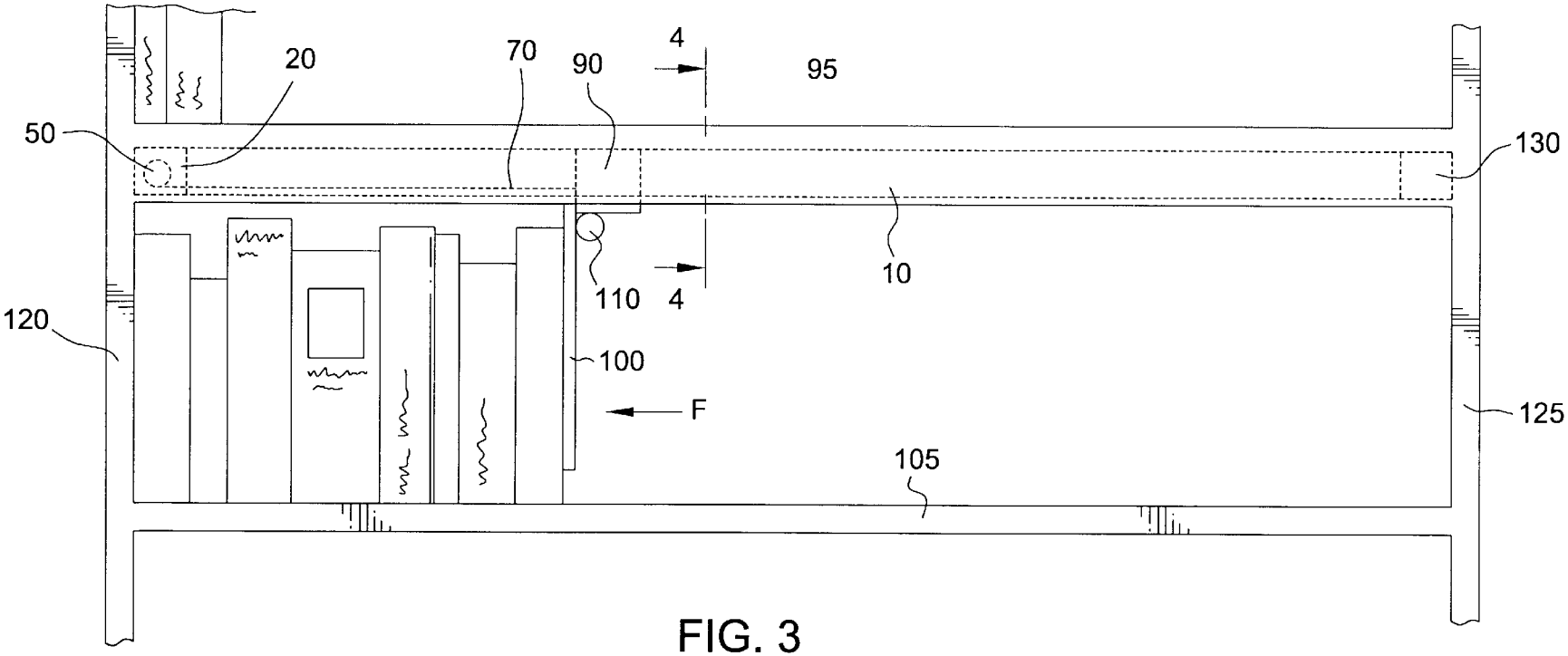
FIG. 3 illustrates a side view of a bookshelf incorporating apparatus of an embodiment of the invention.

The apparatus 10 of any of the previously described embodiments can be attached by any of a number of methods. As shown in FIGS. 3 and 5, the base portions 20 and 130 may be provided with a plurality of screw holes through which screws 240 may be inserted to attach the apparatus to the underside of shelf 95. This particular approach is simple and works well to attach the apparatus to a wood shelf or a hollow metal shelf through which the screws can be fixedly inserted. Although two screw holes are shown, one may utilize more or less screws and modify their locations depending on the dimensions and weight of the apparatus 10. Other methods of attachment are possible such as double sided adhesive that can be attached to the base portions 20 and 130 and/or track sections 30 and then adhered to the underside of shelf 95. This particular method works well on smooth nonporous surfaces such as metal, plastic or laminated wood and when the retaining apparatus is not overly long or heavy. Many acceptable double sided adhesives are commercially available.

Other suitable methods of affixing the retaining apparatus to a shelf unit may also be used. For example, the apparatus may be hung to a vertical back wall or side wall of the shelf unit either by screws, clamps, adhesive or the like.

Figure 17:
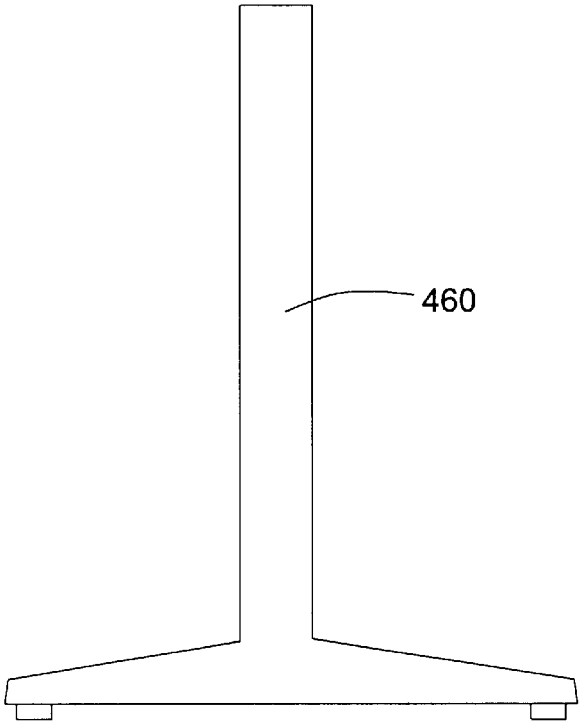
FIGS. 17–18 illustrate a side view and end view, respectively, of a typical library shelf assembly.
Figure 18:
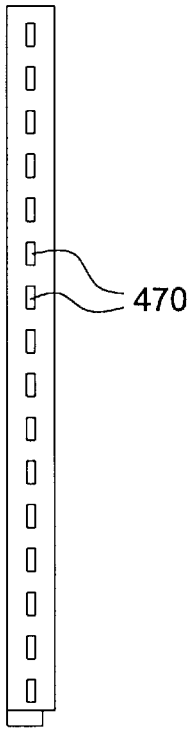
Figure 19:
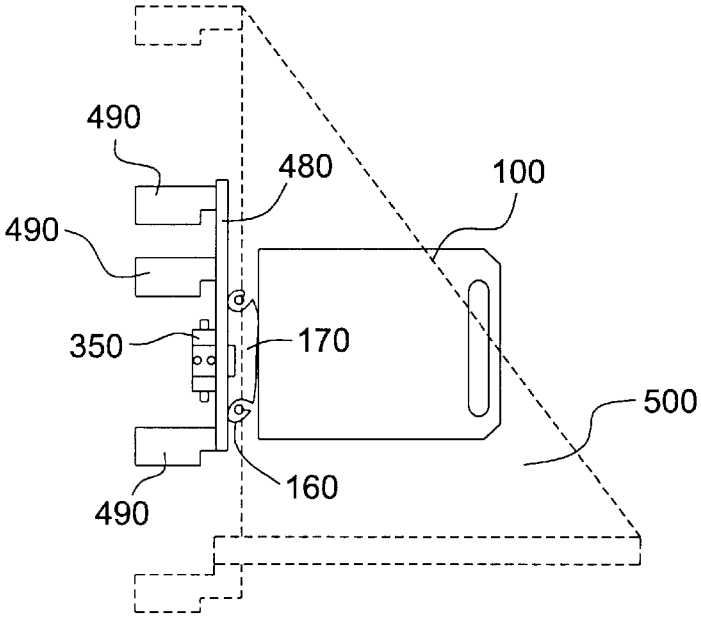
FIG. 19 illustrates a preferred mounting structure for affixing the retaining apparatus of the invention to the shelving shown in FIGS. 17–18.

Additionally, as shown in FIGS. 17–19, the retaining apparatus can be affixed to typical library shelving. Typical library shelving may include left and right vertical supports 460 having a plurality of vertically spaced slots 470 located on front and/or back sides of the supports and shelving appropriately notched for arrangement in various configurations on supports 460. As shown in FIG. 19, a support fixture 480 is provided with a plurality of notched retaining members 490 that mate with and are received within slots 470 of supports 460. Track section 160 is fixedly mounted on fixture 480 as shown. As several slots 470 are vacant between adjacent shelves (shown in outline form as shelf 500), this makes for a very convenient method of attachment, allowing easy adjustment of bookend height to accommodate different height books on the shelving.

The particular constant force spring(s) used in any of the preceding embodiments is/are selected so as to provide a predetermined constant biasing force to the bookend to retain books or other objects in an upright position between the bookend and a vertical support. The benefits from use of a constant force spring are numerous. First, the coil of a constant force spring can be small and compact, taking up little space in any dimension, but can unwind to great lengths. As such, constant force springs provide a great degree of flexibility in the amount of travel that can be achieved with the inventive apparatus. Such a spring can accommodate a shelf with as few as one or two books on it or a substantially full shelf. Second, constant force springs apply an even force throughout the entire travel of the spring, thus the name. This has been found by applicants to be more desirable than springs such as helical compression or tension springs, which tend to apply more force as they are further compressed or extended depending on the type of spring used.

The specific force of spring 50 selected can meet various criteria depending on the particular desired result of the apparatus. If merely "supporting" is desired, a spring with sufficient force to keep a book from falling over will suffice. Such a force is preferably selected to be just above a force value necessary to maintain an upright position of the books and below a force value that would physically move book(s) laterally along the shelf. Such a configuration will maintain openings created between books in a set when one or more books are removed, but are to be subsequently returned. This is typically the case in a library where books have a designated location and will be returned to the same location when reshelved.

Alternatively, if "gap closing" is desired, a force value can be selected sufficient to physically force one or more books in the set into close relationship with adjacent books to take up and eliminate space created between books in the set caused by removal of one or more books. Sometimes it may be desired to eliminate such gaps.

For example, in a book store, books are displayed for sale on a shelf. Purchased books are not going to be returned and it is not always known if they will be replaced. In such a case, for aesthetic display purposes, it may be beneficial to eliminate any gaps created by removed books.

The particular force of spring chosen is selected based on the anticipated or determined size and weight of books to be placed on the shelf. For example, reference books on a shelf in a library, such as an encyclopedia collection, would require a higher spring force for either criterion than paperback novels on a shelf would require. To provide greater flexibility, several constant force springs having varying force values can be provided. These can be individually utilized and interchanged to achieve a desired spring force or can be combined together in sets of two or more (parallel connection) to achieve higher combined force values while still having minimal size. For instance, light, medium and heavy springs can be provided, preferably two of each. If a light book load is to be supported, only one light spring could be used, even if the apparatus is the one shown in FIG. 1 with two track sections. If a heavier load of books is required, either one medium spring or two light springs can be utilized. Thus, a suitable spring force can be selected that most closely approximates an optimal spring force value for a particular application. Attachment of the uncoiled end of the spring with pins can facilitate interchange of springs.

Figure 6:
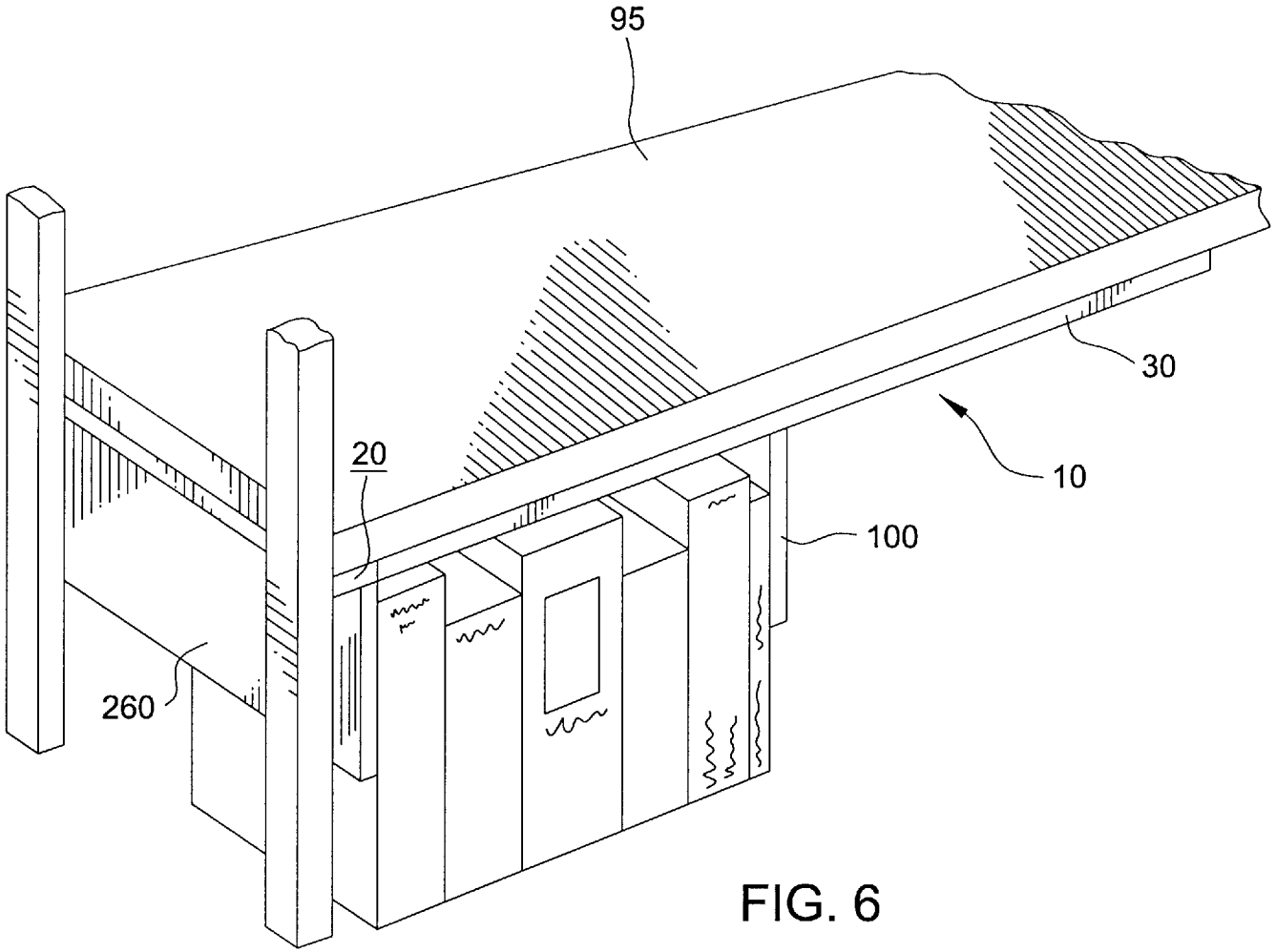
FIG. 6 illustrates a perspective view of an apparatus according to an embodiment of the invention.

In FIG. 6, retaining apparatus 10 is shown for use with a shelf having little or no vertical wall that could provide a stable vertical fixed support to support the books. In this example, the apparatus 10 is provided with at least one vertical, fixed support 260. The vertical support 260 is shown located at the leftmost part of the apparatus 10; however, it may be located anywhere along the apparatus and may be provided at each end of the apparatus 10. A suitable location for vertical support 260 is affixed to and downwardly extending from base portion 20. With such an arrangement, books may be adjustably supported between the at least one vertical support 260 and the movable bookend 100. This embodiment is especially well suited for use with shelving having frame type vertical members (as shown) and can retain books located on the floor below the shelving without utilizing external bookends on the floor.

Additionally, to aid in moving books or other objects between the adjustable vertical bookends, one or more strips of a low coefficient of friction material can be provided. This material can be placed on or affixed to an upper surface of a shelf on which books or other objects are to be placed to reduce the friction between the surface and the books. This allows one or more books within the book/object set to freely slide laterally when biased by the apparatus.

The invention has been described with reference to preferred embodiments thereof, which are illustrative and not limiting. Various changes may be made without departing from the spirit and scope of the invention as defined in the appended claims.

What is claimed is:

1. An apparatus for supporting a variable number of objects, comprising:

at least two relatively movable support members comprising surfaces defining opposed planes of support for the objects;

at least one track section provided between said two relatively movable support members; and at least one constant force spring operably connecting said two support members to support said variable number of objects therebetween, at least one of said two support members being connected to a track element constrained for movement along the at least one track section and said constant force spring being located within said at least one track section.

2. The apparatus according to claim 1, wherein said constant force spring has a tensile spring force with a value sufficient to support said objects in an upright position without laterally moving one or more of said objects.

3. The apparatus according to claim 1, wherein said constant force spring has a tensile spring force with a value sufficient to laterally move one or more of said objects.

4. The apparatus according to claim 1, wherein one of said two relatively movable support members further comprises a structure supporting a coiled end of said constant force spring.

5. The apparatus according to claim 4, wherein said structure includes a narrow aperture through which an intermediate portion of said constant force spring can move.

6. The apparatus according to claim 1, wherein one of said two relatively movable members includes a shaft on which a coil of said constant force spring is supported.

7. The apparatus according to claim 1, wherein one of said two relatively movable support members is formed by a vertical wall of a shelf unit.

8. The apparatus according to claim 1, wherein two or more constant force springs in parallel operably connect said two relatively movable members.

9. The apparatus according to claim 1, further comprising attachment means for attachment of said apparatus to a shelf unit.

10. The apparatus according to claim 1, further comprising a handle connected to one of said two relatively movable members.

11. An apparatus for supporting a variable number of objects, comprising:

at least two relatively movable support members comprising surfaces defining opposed planes of support for the objects;

at least one tension spring operably connecting said two relatively movable support members to support said variable number of objects therebetween; and a governor operably connected to at least one of said relatively movable members and governing rate of movement of said relatively movable support members relative to each other.

12. The apparatus according to claim 11, wherein said governor is a one-way governor.

13. The apparatus according to claim 11, wherein said governor is a two-way governor.

14. The apparatus according to claim 11, wherein said at least one tension spring comprises one or more constant force springs.

15. The apparatus according to claim 14, wherein two or more said constant force springs are operably positioned in parallel.

16. An apparatus for supporting a variable number of objects, comprising:

at least two relatively movable support members comprising surfaces defining opposed planes of support for the objects;

at least one tension spring operably connecting said two relatively movable support members to support said variable number of objects therebetween; and a lock operably connected to said apparatus to lock the two relatively movable members in a spaced position.

17. The apparatus according to claim 1, comprising:

a first said constant force spring operably connected between a first said relatively movable support member and a second said relatively movable support member to bias said first support member toward said second support member with a predetermined spring force; and a second said constant force spring operably connected between said second support member and a third said relatively movable support member to bias said third support member toward said second support member with a predetermined spring force.

18. An apparatus for supporting a variable number of objects between two surfaces, comprising:

at least one track section positionable parallel to a horizontal shelf;

at least one movable track element constrained for longitudinal movement along said at least one track section;

at least one support member comprising a surface defining a plane of support for the objects, operably connected to said at least one track element for movement therewith; and at least one constant force spring operably connected to said at least one track element to apply a predetermined biasing force along the track section to said at least one track element.

19. The apparatus according to claim 18, wherein said at least one constant force spring includes a coil and an opposite end, said coil being fixedly supported and said opposite end of said at least one constant force spring being operably connected to said at least one movable track element.

20. The apparatus according to claim 18, wherein said at least one constant force spring includes a coil supported by said at least one track element.

21. The apparatus according to claim 18, comprising two parallel track sections.

22. The apparatus according to claim 18, wherein said at least one constant force spring is located within said at least one track element.

23. The apparatus according to claim 18, wherein said at least one track section is telescopic.

24. The apparatus according to claim 18, wherein a coil of said at least one constant force spring is supported on a shaft, said shaft being constrained by a stationary base.

25. The apparatus according to claim 18, wherein said at least one support member includes a handle.

26. The apparatus according to claim 18, further comprising attachment means for attaching said apparatus to a shelf unit.

27. The apparatus according to claim 18, comprising two or more said constant force springs in parallel.

28. The apparatus according to claim 18, wherein said at least one constant force spring has an overall tensile spring force with a value sufficient to support said objects in an upright position without laterally moving one or more of said objects.

29. The apparatus according to claim 18, wherein said constant force spring has a tensile spring force with a value sufficient to laterally move one or more of said objects.

30. The apparatus according to claim 18, further comprising a governor operably connected to said at least one constant force spring.

31. The apparatus according to claim 18, further comprising a lock mechanism operably connected to said at least one support member to lock said support member at a predetermined position along said track section.

* * * * *